US005353871A

United States Patent [19]

Eslinger et al.

[11] Patent Number: 5,353,871

[45] Date of Patent: Oct. 11, 1994

[54] INFLATABLE PACKER WITH PROTECTIVE RINGS

[75] Inventors: David M. Eslinger, Broken Arrow, Okla.; Robert M. Sorem, Sugar Land, Tex.

[73] Assignee: Dowell Schlumberger Incorporated, Sugar Land, Tex.

[21] Appl. No.: 128,353

[22] Filed: Sep. 28, 1993

[51] Int. Cl.[5] ..... E21B 33/127

[52] U.S. Cl. ..... 166/187; 166/195

[58] Field of Search ..... 166/187, 191, 179, 122

[56] References Cited

U.S. PATENT DOCUMENTS

| | | | |
|---|---|---|---|
| B 430,326 | 3/1876 | Hutchison | 166/187 X |
| 4,003,581 | 1/1977 | Hutchison | 166/187 X |
| 4,082,298 | 4/1978 | Sanford | 166/187 X |
| 4,406,461 | 9/1983 | McGill | 166/187 X |
| 4,424,861 | 1/1984 | Carter, Jr. et al. | 166/187 X |
| 4,886,117 | 12/1989 | Patel | 166/187 |
| 4,892,144 | 1/1990 | Coone | 166/187 X |
| 4,979,570 | 12/1990 | Mody | 166/187 X |
| 5,280,824 | 1/1994 | Eslinger et al. | 166/187 |

*Primary Examiner*—Ramon S. Britts
*Assistant Examiner*—Frank S. Tsay
*Attorney, Agent, or Firm*—Stephen A. Littlefield

[57] ABSTRACT

An inflatable packer apparatus having an inner elastomer sleeve covered by armor such as overlapped, longitudinal slats that extend between upper and lower collars. The end portions of such slats pass through stress rings having outwardly flared nose portions, and thin protector rings mounted inside the nose portions are employed to distribute very localized contact loads form the edge of the slats to the stress rings to prevent the formation of cracks in such rings. The apparatus further includes an elastomeric sleeve member which is expanded into sealing contact with a well bore wall by fluid pressure applied to the inside of the inner elastomeric sleeve member.

4 Claims, 1 Drawing Sheet

FIG. 1
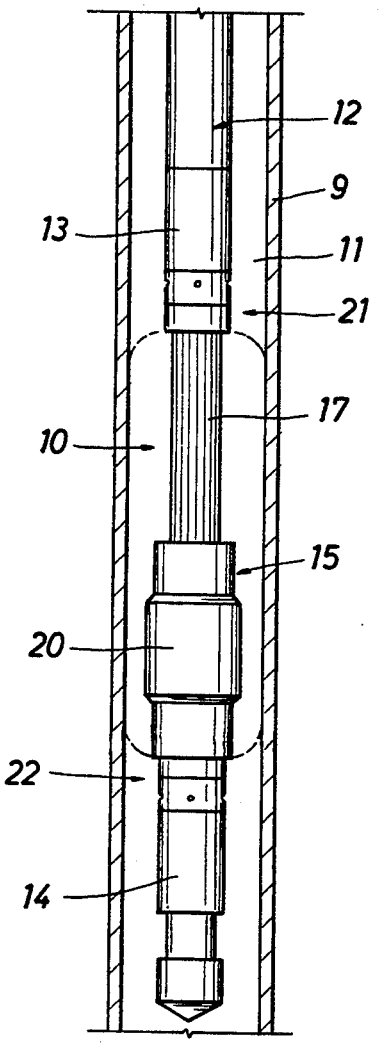
FIG. 2
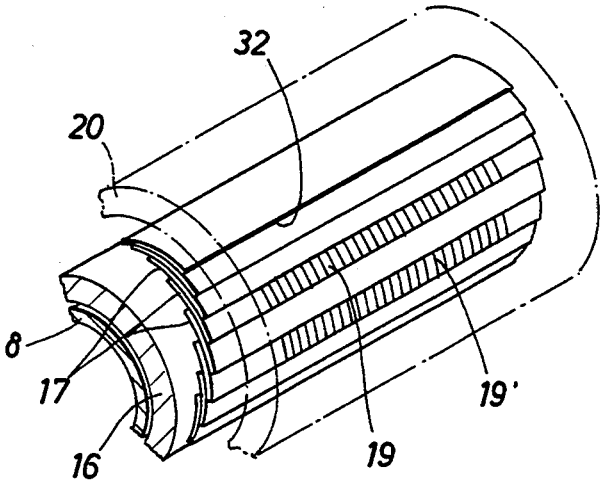
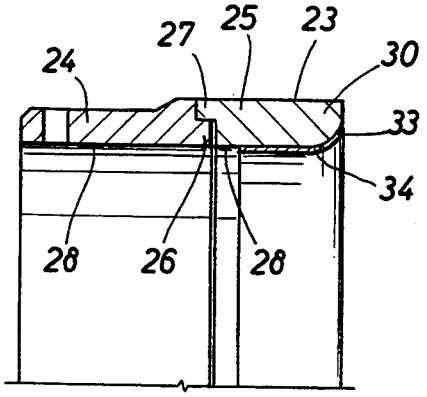
FIG. 3
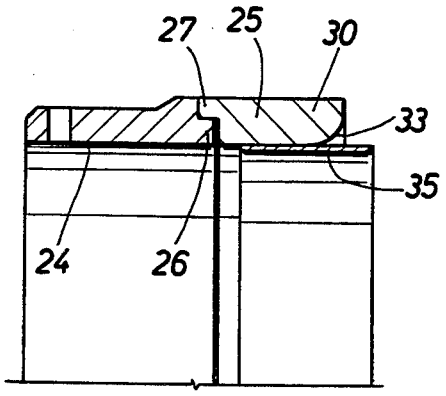
FIG. 4

INFLATABLE PACKER WITH PROTECTIVE RINGS

FIELD OF THE INVENTION

This invention relates generally to improved inflatable packers that are used to bridge or isolate a zone in a well, and particularly to a slat-style inflatable packer where thin protector rings are attached to the stress rings at the ends of the packer element to prevent damage to such rings during operation at high differential pressures.

BACKGROUND OF THE INVENTION

Inflatable packers are used in the oil industry during testing, completion and workover operations to bridge a well bore or to isolate a zone therein. A typical inflatable packer has a tubular body that carries upper and lower retainer rings to which the adjacent ends of an inflatable packer element are attached. In response to the application of fluid pressure to the inside of the packer element, it expands outward into sealing engagement with the surrounding well bore well.

One type of inflatable packer element has an inner elastomer sleeve or bladder that is surrounded by an armor assembly which can be a plurality of circumferentially spaced, overlapped slats, reverse-layed cables, or a composite of woven materials such as cables or wires. An outer elastomer sleeve covers all or a part of the armor assembly to provide a leak proof seal with the well bore wall when the inner sleeve is pressurized and expanded. The end portions of the armor assembly extend underneath stress rings to where they are joined to retainer rings by welding. During operation of the packer at high differential pressures, each end portion of the armor has outer .edges that tend to indent the nose of its associates stress ring which can cause one or more small initial cracks to appear therein. Since the stress ring is very highly stressed normal to such indentations, the cracks tend to propagate and cause failure on the stress ring and thus the packer element. Thus such indentations can limit the operating differential pressure of the packer in an undesirable manner.

The general object of the present invention is to provide a new and improved inflatable packer of the type described having protectors which distribute the localized loads and thereby minimize indentations in the packer stress rings under high differential pressure operations.

SUMMARY OF THE INVENTION

This and other objects of the present invention are attained through the provision of an inflatable packer apparatus which include thin protector rings which are mounted so as to cover the nose portions of each stress ring which surround end portions of the armor. Such protector rings closely match the contour of the noses of the stress rings, or can initially have a cylindrical cross-section that is formed to the shape of the stress ring nose by the end portions of the armor during operation of the packer. The rings function to distribute very localized slat contact loads, which minimizes indentations in the stress rings and the formation of cracks. Thus the operating differential pressure of the inflatable packer is substantially improved.

BRIEF DESCRIPTION OF THE DRAWINGS

The present invention has other objects, features and advantages which will become more clearly apparent in connection with the following detailed description of preferred embodiments in which:

FIG. 1 is a schematic view showing an inflatable packer disposed in a well bore on a running string;

FIG. 2 is a fragmentary isometric view of the inflatable packer shown in FIG. 1;

FIG. 3 is a fragmentary, enlarged sectional view that illustrates one embodiment of a protector ring of the present invention; and FIG. 4 is a view similar to FIG. 3 showing another embodiment of the invention.

DETAILED DESCRIPTION OF PREFERRED EMBODIMENTS

Referring initially to FIG. 1, an inflatable packer 10 is shown suspended in a well bore 21 on a running string 12 of jointed or coil tubing. The packer 10 includes a tubular body 8 that carries upper and lower retainer rings 13, 14. A packer element 15 includes an inner elastomer sleeve 16 (FIG. 2) which has its opposite ends secured to collars which are mounted inside the retainer rings 13, 14, such sleeve being surrounded by an armor assembly that and includes a plurality of circumferentially spaced, partially overlapped metal slats 17. The opposite ends of the slats 17 also are secured to inner metal rings by welding or the like. Although an overlapped slat-type construction is shown, the armor assembly could comprise opposite layed cables, or a composite of woven cables or wires. To provide a leak-proof seal against the well bore wall, an outer elastomer sleeve 20 covers at least a portion of the slats 17 so as to be pressed against the well wall when internal fluid pressure is applied to expand the inner sleeve 16 and the slats 17.

Upper and lower stress ring assemblies 21, 22 are mounted adjacent the retainer rings 13, 14 as shown in FIG. 1. Each stress ring 25 is generally tubular and has an outer cylindrical surface 23 that can be somewhat larger than the o.d. of the back-up ring 24, and an inner cylindrical surface 28 that fits closely around the end portions of the slats 17. The nose 30 of each stress ring has an inner surface 33 that flares outward, as shown, in order to distribute the bending of the slat or other armor portions over a substantial radius when the element 16 is expanded so that such portions do not undergo permanent deformation that might otherwise prevent the element from fully retracting when inflation pressure is released.

As shown in FIG. 2, the slats 17 have outer edges 32 that tend to make indentations in the inner surface of the nose 30 of a stress ring 25 under high differential pressure, which can cause small cracks to appear therein. Such cracks tend to propagate, once formed, which can lead to packer failure. In order to prevent such indentations, a thin protector ring 34 is attached inside the nose portion 30 of each stress ring 25 as shown in FIG. 3. The ring 34, which can be made of copper, brass, plastic or a similar material, has a profile that closely matches the flared contour of the stress ring nose portion 30, and thus distributes the very localized contact loads to minimize indentations in the stress ring. In this manner the operating differential pressure of the packer 10 is substantially improved.

As shown in FIG. 4, another embodiment of a protector ring 35 initially has a cylindrical cross-section that is formed to the contour of the inner flared surface 33 of the stress ring nose 30 by outward pressure of the slats 17 during operation of the packer 10. Here again the very localized contact loads are distributed in a manner that minimizes any indentations in a stress ring, so that the operating differential pressure of the packer is substantially improved. The ring 35 can be made of the same material of the other ring 34.

OPERATION

In operation the packer 10 is assembled as shown in the drawings and is lowered into the well bore 11 on the running string 12. Although the well bore 11 is shown in FIG. 1 as being cased at 9, it can be uncased (open hole). When the packer 10 has been lowered to setting depth, pressure is applied to the interior of the elastomer sleeve 16 via the running string 12 which causes the packer element 15 to expand or balloon outward until the outer elastomer sleeve 20, as well as the uncovered portions of the slats 17, engage the well bole wall. The sleeve 20 prevents fluid leakage, while the slat portions 17 provide a frictional anchor against longitudinal movement. The packer 10 provides a bridge in the well bore 11 which enables various service work to be done.

The inner surfaces of the thin protector ring 34 shown in FIG. 3 are engaged by the outer edges 31 of the overlapped slats 17 so that localized contact loads are distributed in a manner that minimizes the formation of indentations in the stress ring and resulting cracks that can cause failure thereof. The embodiment shown in FIG. 4 works in a similar manner except that the sleeve 35, which is initially cylindrical, is formed into the generally outwardly flared shape of the ring surface 33 by the outward pressure of the slat portions during expansion of the inflatable packer element 15. Thus formed, the rings 34 or 35 distribute loads to the stress rings 25 so that the formation of cracks therein is minimized.

If it is desired to retract the packer element 15 so that the packer assembly 10 can be either removed from the well, or moved to another setting location, the fluid pressure that is being applied to the interior of the inner elastomer sleeve 16 is relieved so that it inherently retracts to a tubular form on account of its resilience. For the same reason, the slats 17 also straighten to their original positions. Of course the outer sleeve 20 which also is made of an elastomeric material, returns to its original retracted condition. Then the packer assembly 10 is free to be moved longitudinally in the well bore 11. Of course the packer 10 could be permanently set in the well bore by maintaining the inflation pressure.

It now will be recognized that a new and improved inflatable packer apparatus has been provided which includes thin protection rings which distribute very localized contact loads on stress rings to prevent or at least minimize the formation of cracks in the stress rings or collars, thereby improving the operating differential pressure of the packer. The armoring material which is used in the packer assembly can be overlapped slat, reverse-layed cables, or composite woven cables or wires. Since certain changes or modifications may be made in the disclosed embodiment without departing from the inventive concepts involved, it is the aim of the appended claims to cover all such changes and modifications falling within the true spirit and scope of the present invention.

What is claimed is:

1. An inflatable well packer apparatus comprising: a tubular body member carrying upper and lower connector sleeves; armoring means extending between and connected to said connector sleeves; an inner elastomer sleeve member between said body member and said armoring means; an outer elastomer sleeve member covering at least a portion of said armoring means; an upper stress ring mounted adjacent said upper connector sleeve and a lower stress ring mounted adjacent said lower connector sleeve, each of said stress rings surrounding an end portion of said armor means; and protective ring means positioned inside each of said stress rings for distributing localized loads applied by said end portions of said armor means to said stress rings during inflation and expansion of said packer apparatus to prevent the formation of cracks in said stress rings in response to said loads.

2. The apparatus of claim 1 wherein each of said stress rings has a nose portion with an outward flared inner surface, said protective ring means each comprising a thin member having a profile that closely matches the contour of said flared inner surface.

3. The apparatus of claim 1 wherein each of said stress rings has a nose portion with an outwardly flared inner surface, said protective ring means each comprising a thin cylindrical member located within said flared surface and arranged to be spread outward into conformity with said flared inner surface as said packer apparatus is inflated.

4. The apparatus of claim 1 wherein said armor means includes circumferentially spaced, overlapped metal slat members.

* * * * *